US011311785B1

(12) United States Patent
Woullard

(10) Patent No.: US 11,311,785 B1
(45) Date of Patent: Apr. 26, 2022

(54) SWING TRAINER FOR BASEBALL AND SOFTBALL

(71) Applicant: Luther T. Woullard, Petal, MS (US)

(72) Inventor: Luther T. Woullard, Petal, MS (US)

( * ) Notice: Subject to any disclaimer, the term of this patent is extended or adjusted under 35 U.S.C. 154(b) by 0 days.

(21) Appl. No.: 16/988,832

(22) Filed: Aug. 10, 2020

(51) Int. Cl.
*A63B 69/00* (2006.01)

(52) U.S. Cl.
CPC .. *A63B 69/0002* (2013.01); *A63B 2069/0008* (2013.01); *A63B 2225/093* (2013.01)

(58) Field of Classification Search
CPC ..... A63B 69/0002; A63B 2069/0008; A63B 2225/093
USPC ..... 473/453, 422–430, 454, 451, 417, 446
See application file for complete search history.

(56) References Cited

U.S. PATENT DOCUMENTS 3,386,733 A * 6/1968 Russo ..... A63B 69/0002 473/453
3,475,026 A * 10/1969 Cooper ..... A63B 69/0002 473/430
3,940,131 A * 2/1976 St. Claire, Jr. ..... A63B 69/0002 473/417
4,451,036 A 5/1984 Sinclair et al.
4,516,771 A 5/1985 Nau
5,087,039 A * 2/1992 Laseke ..... A63B 69/0002 473/417
5,352,170 A * 10/1994 Condo ..... A63B 69/201 482/83
5,478,070 A 12/1995 Ntffrison
5,924,930 A * 7/1999 Stewart ..... A63B 69/0079 473/29
6,435,990 B1 8/2002 Bradley
7,300,365 B2 * 11/2007 Taylor ..... A63B 69/0057 473/422
8,602,920 B2 12/2013 Windsor
10,245,493 B2 * 4/2019 Beedle ..... A63B 69/0075
2005/0266936 A1 * 12/2005 Gutierrez ..... A63B 69/0002 473/417
2006/0240917 A1 * 10/2006 Campbell ..... A63B 69/0002 473/453
2015/0105187 A1 * 4/2015 Willardson ..... A63B 69/0002 473/417
2017/0065865 A1 * 3/2017 Beedle ..... A63B 69/0002

* cited by examiner

*Primary Examiner* — Nini F Legesse
(74) *Attorney, Agent, or Firm* — George L Williamson

(57) ABSTRACT

Method and apparatus for a baseball and softball swing trainer that includes being an adjustable swing trainer which can be adjusted for height, for angular relationship with ground and batter, and to the angular relationship for different heights of strike zones for batters of different height by providing adjustable means disposed on an upright standing elongated rod mounted on a base stand. The device includes adjustments for changing the height of the device relative to the ball height, and also to the bat angle, and also to the batter's strike zone without actually using a ball as part of the trainer. The fork member is made out of plastic or other non-breakable, flexible material to allow it to be durable and not to break when hit by the bat. An adjustable fork and various sizes of fixed forks are also provided so that the distance between the forks vary according to the batting skill of the batter.

14 Claims, 2 Drawing Sheets

SWING TRAINER FOR BASEBALL AND SOFTBALL

BACKGROUND OF THE INVENTION

Field of the Invention

The present invention relates generally to athletic training devices, and more particularly, is concerned with a baseball and softball batting training tee.

Description of the Related Art

Devices relevant to the present invention have been described in the related art; however, none of the related art devices disclose the unique features of the present invention.

In U.S. Pat. No. 4,516,771 dated May 14, 1985, Nau disclosed a batting aid. In U.S. Pat. No. 5,478,070 dated Dec. 26, 1995, Morrison disclosed a ball and bat trainer tee and guide assembly. In U.S. Pat. No. 6,435,990 dated Aug. 20, 2002, Bradley disclosed a batting skills training device. In U.S. Pat. No. 4,451,036 dated May 29, 1984, Sinclair, et al., disclosed a batting practice device. In U.S. Pat. No. 8,602,920 dated Dec. 10, 2013, Windsor disclosed an apparatus for training swing of a batter.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a baseball and softball swing trainer that includes being an adjustable swing trainer which can be adjusted for height, for angular relationship with ground and batter, and to the angular relationship for different heights of strike zones for batters of different height by providing adjustable means disposed on an upright standing elongated rod mounted on a base stand. The present invention includes adjustments for changing the height of the device relative to the ball height, and also to the bat angle, and also to the batter's strike zone without actually using a ball as part of the trainer. The fork member is made out of plastic or other non-breakable, flexible material to allow it to be durable and not to break when hit by the bat. Various sizes of fixed forks are also provided so that the distance between the forks vary according to the batting skill of the batter.

An object of the present invention is to provide a swing training tee to train the memory of the muscles of the batter that control. A further object of the present invention is to provide a swing trainer that is portable and can be used in any available space including indoors and outdoors. A further object of the present invention is to provide a swing trainer that does not use a baseball or other ball as a part of the training procedure. A further object of the preset invention is to provide a swing trainer that allows a user to swing a bat between the two fixed rods of a forked member without touching either prong. A further objective is to allow the user to swing a baseball bat between the two fixed rods without touching either the lower or upper fork member. A further object of the present invention is to provide a swing trainer that can be easily used by a batter. A further object of the present invention is to provide a swing trainer that can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
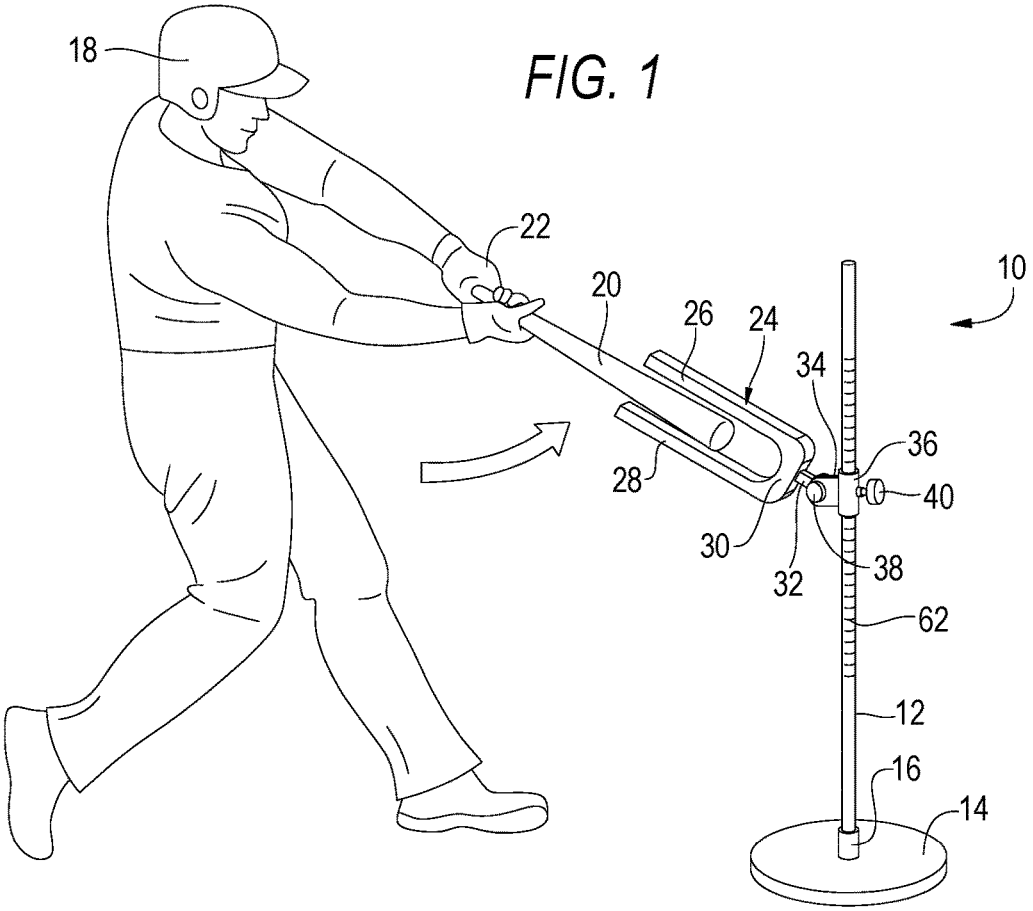
FIG. 1 is a perspective view of the present invention shown in operative connection.

With regard to reference numerals used, the following numbering is used throughout the drawings.

10 present invention
12 elongated rod
14 support base
16 receptacle
18 batter
20 bat
22 hands
24 fork member
26 first fork prong
28 second fork prong
30 base portion of fork
32 arm/stem
34 arm member
36 collar
38 angular knob
39 wing nut
40 height knob
42 first rod section
44 second rod section
46 male threaded member
48 female threaded member
50 space
51 ball
52 first fork member
54 second fork member
56 fork adjustment knob
58 base arm
60 base receptacle
62 indicia

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 6 illustrate the present invention wherein a swing trainer for baseball or softball is disclosed and which is generally indicated by reference numeral 10.

Turning to FIG. 1, therein is shown the swing trainer of the present invention 10 which includes an elongated upright rod 12 disposed on a support base 14 by means of a receptacle 16 disposed on an upper surface of the support base so that the rod can be removably screwed into or friction fit into the receptacle. Also shown is a batter 18 having a bat 20 for being gripped and swung in the batter's hands 22 by swinging the bat between the upper and lower prong members of a forked member 24 which has a first fork prong 26 and a second fork prong 28 so that the bat of the batter must be guided carefully between the first and second prongs of the fork. The fork 24 also has a base portion 30 thereon which has stem or arm 32 with a pointer on its end extending therefrom which is joined to a second arm member 34 by means so that the fork 24 is pivotable on that arm 34 which arm 34 is connected to a slidable collar 36 which is mounted on and slides up and down the elongated rod 12 so that the fork member 24 is angularly adjustable using the knob 38 and is height adjustable using knob 40.

Figure 2:
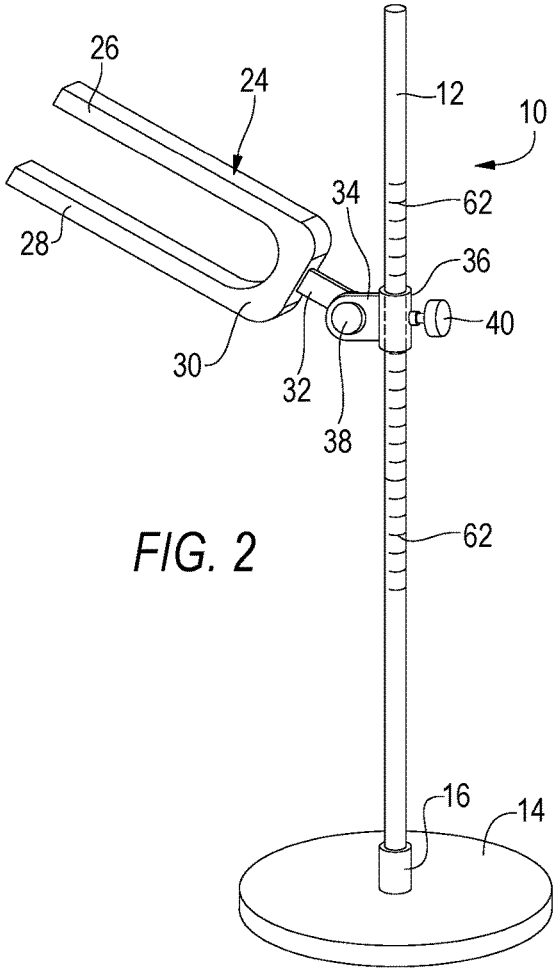
FIG. 2 is a perspective view of one side of the present invention showing a first size of fork.
Figure 3:
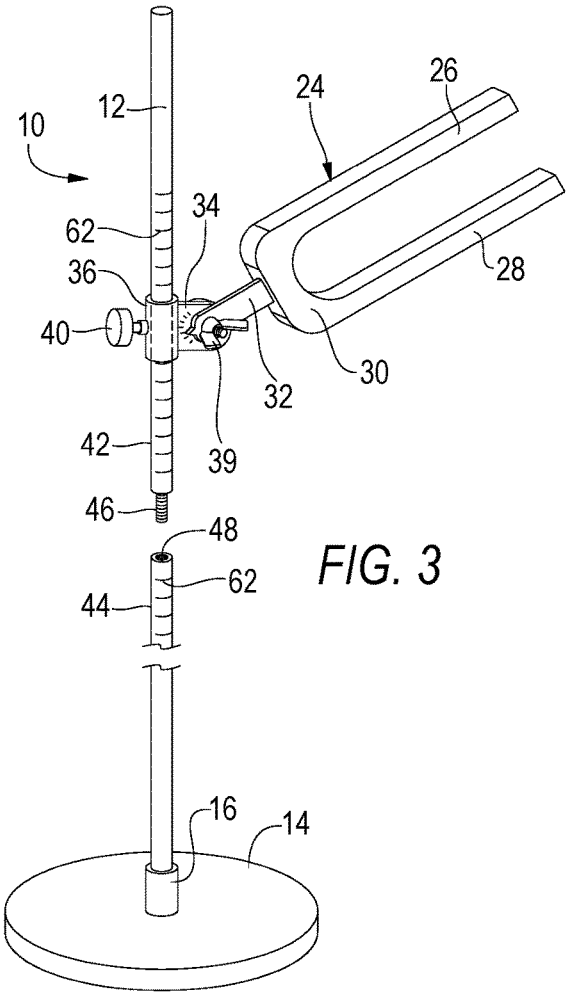
FIG. 3 is a perspective view a second side of the present invention showing a second size of fork.

Turning to FIGS. 2-3, therein is shown an embodiment of the present invention wherein the elongated rod 12 can be made so as to have multiple sections 42, 44 which are joined together by a threaded portion 46 on an end of one of the members 42 so that the male threaded portion can be placed in a female threaded aperture 48 so that the two pieces 42, 44 can be easily screwed together and taken apart so that the present invention 10 can be stored more easily. Previously disclosed elements are also shown.

Figure 4:
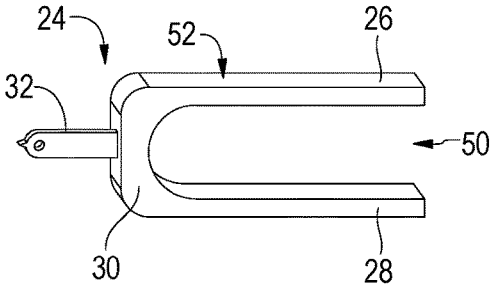
FIG. 4 is a perspective view of a first size of fork for use with the present invention.
Figure 5:
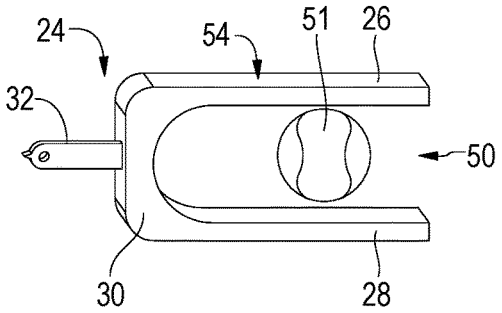
FIG. 5 is a perspective view of a second size of fork for use with the present invention.

Turning to FIGS. 4-5, therein are shown forked members 24 wherein different sizes of the forked member 24 are shown having different widths for spaces 50 between a first fork member 52 and a second fork member 54 wherein the space between the prongs of fork 54 is greater than the space between the prongs of fork 52 so that the more advanced batter would use the fork with the smaller space found in fork 52 versus the wider spaced fork 54. Fork 54 would be more suitable for use by a beginner because the prongs 26, 28 would be more likely to be hit by a beginner. Stem 32 has a pointer on its end. FIG. 5 shows exemplary ball 51 between the prongs 26, 28 with ball 51 being about the same size diameter as width of space 50 of fork 54; the prongs could be selectively sized to be larger or smaller, e.g., see FIG. 4 which is smaller, than the diameter of a standard baseball or softball depending on the skill level of the batter.

Figure 6:
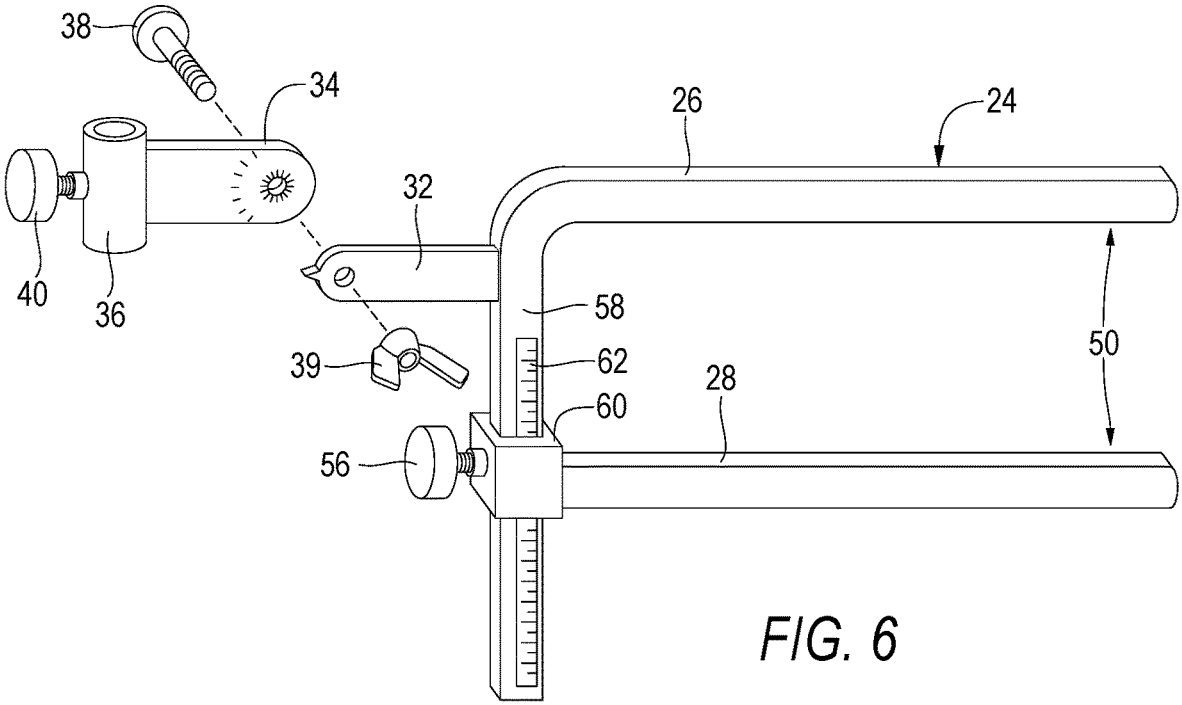
FIG. 6 is an exploded view of an adjustable fork for use with the present invention.

Turning to FIG. 6, therein is shown an embodiment which includes a fork member 24 wherein the size of the space 50 between prongs of the fork 26, 28 can be easily adjusted using an adjustment knob 56 mounted onto the base portion 60 of the lower fork prong 28 so that the base 58 formed by the upper fork prong 26 passes through the receptacle 60 of the lower fork prong 28 and wherein indicia 62 provide a measurement scale with numbers thereon so that the distance 50 between fork prong members 26, 28 can be very easily manually adjusted so that the same fork member 24 can be used by the different skill levels of batters. The fork member 24 shown in FIG. 6 is similar to the other fork members in that it has a stem/arm 32 with a pointer on its tip joined to another arm 34 with indicia which has an adjustment screw 38 and wing nut 39 thereon wherein the angle of the fork can be easily varied. Also, the collar 36 has a height knob 40 thereon which will allow the adjustable fork member 24 to be moved up and down the rod 12 as previously demonstrated to adjust its height.

In operation, the present invention 10 has a knob 56 which allows the adjustable fork member 24 to be adjusted so as to vary the ball height or size of batting target zone 50 by easily loosening knob 56 and moving base receptacle 60 up and down the base 58 of the fork member 24 while providing a second knob 38 which varies the angle of the adjustable fork member 24 relative to the horizontal plane and also providing a third adjustment knob 40 which allows the present invention 10 to be adjusted to adapt to the height of the individual batter's strike zone.

The present invention 10 could be made so that the elongated rod 12 can be manufactured of metal or plastic materials and the forked member 24 could be molded of flexible plastic materials in various sizes or by using the adjustable embodiment for varying the ball height, i.e., the approximate distance between the upper 26 and lower fork prongs 28, and wherein the prongs 26, 28 could be 12 to 18 inches long. The elongated rod 12 could be about 30 inches long and could be made of plastic and including a two-piece construction wherein the lower part of rod 12 could screw into a receptacle piece which would then screw into base plate 14 so that the base plate and receptacle could be separated for more convenient storage in out-of-the-way places, for example, underneath a bed.

The present invention 10 can be used to train any age batter/player from T-ball to the major leagues as it is adjustable to a player's height, strike zone, and any batting angle.

A further advantage of the present invention 10 is to allow it to adjust to the desired pitch height either up or down by adjusting a knob 40 on its rear end and then tightening the knob and is also adjustable to a bat angle by adjusting the knob 38 on the sides which can then be retightened.

It is known that the diameter of a baseball is greater than the diameter of a baseball bat so that if a batter can be trained to swing a bat between the upper and lower fork-prong members 26, 28 without touching either fork members he can then hit the ball in its center comparatively more often so that there would be fewer pop-ups, ground balls and there would be more line drives with each swing of the bat.

By way of summary and with reference to FIGS. 1-6, the present invention 10 discloses a swing trainer 10 for teaching a batter 18 how to hit a ball 51 with a bat 20 including, a) providing an upright standing rod 12; b) providing a support base 14 for the upright standing rod, wherein a lower end of the upright standing rod is removably secured at 16 to the support base; c) providing a slidable member 36 being selectively slidably disposed on the upright standing rod; d) providing a first locking means 40 on the slidable member for adjusting the height of the slidable member on the upright standing rod; e) providing a first arm 34 on the slidable member extending horizontally away from the slidable member; f) providing a first fork member 24, wherein the first fork member has first 26 and second 28 prongs, a base 30, and a stem 32 disposed on the base extending horizontally away from the base, wherein an end of the stem is pivotally joined at a pivot point 38, 39 to an end of the first arm to permit the angle of the first fork member to be adjusted relative to a horizontal plane; and, g) wherein the first and second prongs have a first space 50 thereinbetween, wherein the first space defines a target zone, wherein the batter swings the bat through the target zone. Also, the step of adjusting the size of the target zone by replacing the first fork member 52 with a second fork member 54 having first and second prongs having a second space thereinbetween for providing a second space between the first and second prongs of the second fork member to permit the size of the target zone to be adjusted, and the step of providing a first adjustment knob 40 on the first locking member on the slidable member for adjusting the height of the slidable member on the upright standing rod, and the step of providing a second adjustment knob 38 on the pivot point disposed on the first arm for adjusting the angle of the first fork member relative to the horizontal plane. Further shown is the step of providing an adjustable fork member (FIG. 6) on the first fork member, whereby the size of the target zone can be adjusted, wherein the adjustable fork member has first and second prongs thereon and a base, wherein the first prong of the means for an adjustable fork member has a curved end proximate the base, wherein the curved end forms the base 58, a base receptacle 60 formed on an end of the second prong for slidably receiving the curved end to permit the size of the target zone to be adjusted and the step of providing a third adjustment knob 56 on the base receptacle for adjusting the size of the target zone.

I claim:

1. A swing trainer for teaching a batter how to hit a ball with a bat, consisting of:

a) an upright standing rod;

b) a support base for said upright standing rod, wherein a lower end of said upright standing rod is removably secured to said support base;

c) a slidable member being selectively slidably disposed on said upright standing rod;

d) a first locking means disposed on said slidable member for adjusting the height of the slidable member on said upright standing rod; horizontally away from said slidable member;

f) a first fork member, wherein said first fork member has first and second prongs, a base, and a stem disposed on said base extending horizontally away from said base, wherein an end of said stem is pivotally joined at a pivot point to an end of said first arm to permit the angle of said first fork member to be adjusted relative to a ground plane;

g) said first and second prongs each being straight rods parallel to each other; and h) wherein said first and second prongs have a first elongated space thereinbetween extending a full length of said first and second prongs, said first and second prongs being spaced so that the bat of the batter must be guided carefully between said first and second prongs, wherein said first elongated space defines a target zone without further structure or said ball being present in said target zone, wherein the batter swings the bat through said target zone.

2. The swing trainer of claim 1, wherein the size of said target zone can be adjusted by replacing said first fork member with a second fork member having first and second prongs having a second space thereinbetween for providing a second space between said first and second prongs of said second fork member to permit the size of said target zone to be adjusted.

3. The swing trainer of claim 2, wherein said first locking member further comprises a first adjustment knob disposed on said slidable member for adjusting the height of the slidable member on said upright standing rod.

4. The swing trainer of claim 3, wherein said pivot point further comprises a second adjustment knob disposed on said first arm for adjusting the angle of said first fork member relative to the horizontal plane.

5. The swing trainer of claim 1, wherein said first fork member further comprises means for an adjustable fork member whereby the size of said target zone can be adjusted, wherein said means for an adjustable fork member has first and second prongs thereon and a base.

6. The swing trainer of claim 5, wherein said first prong of said means for an adjustable fork member has a curved end proximate said base, wherein said curved end forms said base, a base receptacle formed on an end of said second prong for slidably receiving said curved end to permit the size of said target zone to be adjusted.

7. The swing trainer of claim 6, wherein said base receptacle further comprises a third adjustment knob for adjusting the size of said target zone.

8. A method for assembling a swing trainer for teaching a batter how to hit a ball with a bat, consisting of the steps of:

a) providing an upright standing rod;

b) providing a support base for the upright standing rod, wherein a lower end of the upright standing rod is removably secured to the support base;

c) providing a slidable member being selectively slidably disposed on the upright standing rod;

d) providing a first locking means on the slidable member for adjusting the height of the slidable member on the upright standing rod;

e) providing a first arm on the slidable member extending horizontally away from the slidable member;

providing a first fork member, wherein the first fork member has first and second prongs, a base, and a stem disposed on the base extending horizontally away from the base, wherein an end of the stem is pivotally joined at a pivot point to an end of the first arm to permit the angle of the first fork member to be adjusted relative to a ground surface;

g) said first and second prongs each being straight rods parallel to each other; and h) said batter undergoing batting practice by swinging a bat through a first elongated space between the first and second prongs without further structure or a ball being present in said first elongated space, and said first elongated space extending a full length of said first and second prongs, wherein the first elongated space defines a target zone and said first and second prongs being spaced so that the bat of the batter must be guided carefully between said fast and second prongs.

9. The method of claim 8, further comprising the step of adjusting the size of the target zone by replacing the first fork member with a second fork member having first and second prongs having a second space thereinbetween for providing a second space between the first and second prongs of the second fork member to permit the size of the target zone to be adjusted.

10. The method of claim 9, further comprising the step of providing a first adjustment knob on the first locking member on the slidable member for adjusting the height of the slidable member on the upright standing rod.

11. The method of claim 10, further comprising the step of providing a second adjustment knob on the pivot point disposed on the first arm for adjusting the angle of the first fork member relative to the horizontal plane.

12. The method of claim 8, further comprising the step of providing an adjustable fork member on the first fork member whereby the size of the target zone can be adjusted, wherein the means for an adjustable fork member has first and second prongs thereon and a base.

13. The method of claim 12, wherein the first prong of the adjustable fork member has a curved end proximate the base, wherein the curved end forms the base, a base receptacle formed on an end of the second prong for slidably receiving the curved end to permit the size of the target zone to be adjusted.

14. The method of claim 13, further comprising the step of providing a third adjustment knob on the base receptacle for adjusting the size of the target zone.

* * * * *